US005660226A

United States Patent [19]

Finnemore

[11] Patent Number: 5,660,226

[45] Date of Patent: Aug. 26, 1997

[54] ROTOR POST WITH FLOATING TENSILE HEADER

[75] Inventor: Harlan E. Finnemore, Pocatello, Id.

[73] Assignee: ABB Air Preheater, Inc., Wellsville, N.Y.

[21] Appl. No.: 664,145

[22] Filed: Jun. 14, 1996

[51] Int. Cl.[6] ..... F23L 15/02

[52] U.S. Cl. ..... 165/8; 165/9; 165/10; 165/DIG. 17

[58] Field of Search ..... 165/10, 9, 8, DIG. 16, 165/DIG. 17, DIG. 42, DIG. 43

[56] References Cited

U.S. PATENT DOCUMENTS 3,216,488 11/1965 Conde ..... 165/9

FOREIGN PATENT DOCUMENTS 2551850 3/1985 France ..... 165/8
2074301 10/1981 United Kingdom ..... 165/9

*Primary Examiner*—John Rivell
*Assistant Examiner*—Christopher Atkinson
*Attorney, Agent, or Firm*—Chilton, Alix & Van Kirk

[57] ABSTRACT

A rotary regenerative air preheater having a rotor mounted to a central rotor post for rotation within a surrounding housing whereby heat absorbent material carried in the rotor is alternately exposed to a flow of heating gas and a gas to be heated. Upper and lower rotor post headers provide means for mounting diaphragms, which divide the rotor into compartments, to the rotor post. The upper rotor post header includes an interior opening for receiving the rotor and an outer peripheral portion having a plurality of circumferentially spaced T-shaped slots. The upper portion of the inboard end of each diaphragm defines a box-shaped lug which is received in one of the slots. Shoulders defined by the lug engage shoulders defined by the slots to prevent radial movement of the diaphragm. The lower rotor post header is mounted to the rotor and includes a radially extending lower portion that defines a shelf. The lower portion of the inboard end of each diaphragm rests on the shelf such that each diaphragm is supported on the rotor.

15 Claims, 5 Drawing Sheets

ROTOR POST WITH FLOATING TENSILE HEADER

BACKGROUND OF THE INVENTION

The present invention relates to rotary regenerative air preheaters which employ a rotor post for rotation of the rotor and more particularly to novel rotor post headers for mounting the rotor diaphragms.

A rotary regenerative air preheater transfers sensible heat from the flue gas leaving a boiler to the entering combustion air through regenerative heat transfer surface in a rotor which turns continuously through the gas and air streams. The rotor, which is packed with the heat transfer surface, has a rotor post which is supported through a lower bearing at the lower end of the air preheater and guided through a bearing assembly located at the top end for most vertical flow air preheaters. Some vertical flow air preheaters use a top support bearing and a lower guide bearing. The rotor is divided into compartments by a number of radially extending plates referred to as diaphragms. Generally, the bottom inboard edge of the diaphragms are set on a ledge on the lower rotor post header and an upper diaphragm tongue is pinned within an annulus in the upper rotor post header.

In a typical rotary regenerative heat exchanger, the hot flue gas and the combustion air enter the rotor shell from opposite ends and pass in opposite directions over the heat exchange material housed within the rotor. Consequently, the cold air inlet and the cooled gas outlet are at one end of the heat exchanger, referred to as the cold end, and the hot gas inlet and the heated air outlet are at the opposite end of the heat exchanger, referred to as the hot end. As a result, an axial temperature gradient exists from the hot end of the rotor to the sold end of the rotor. In response to this temperature gradient, the rotor tends to distort and to assume a shape similar to that of an inverted dish (commonly referred to as rotor turndown). This distortion causes the diaphragm tongues to move up their mounting pins, imposing a tensile stress on the diaphragm tongue, the pin and the flanges on the upper rotor post header that define the annulus. Consequently, the upper rotor post header comprises a massive structure to provide an annulus having a sufficient height to allow movement of the diaphragm tongue and flanges having sufficient thickness to withstand the tensile stress imposed by the rotor distortion. Such a structure is expensive to manufacture and imposes a large weight burden on the rotor bearing.

SUMMARY OF THE INVENTION

The present invention provides an arrangement of means in an air preheater for mounting rotor diaphragms on the rotor post wherein the mounting means is free to move axially on the rotor post. This reduces the tensile stress on the mounting means, allowing the mass of the mounting means to be reduced.

DESCRIPTION OF THE PREFERRED EMBODIMENTS

Figure 1:
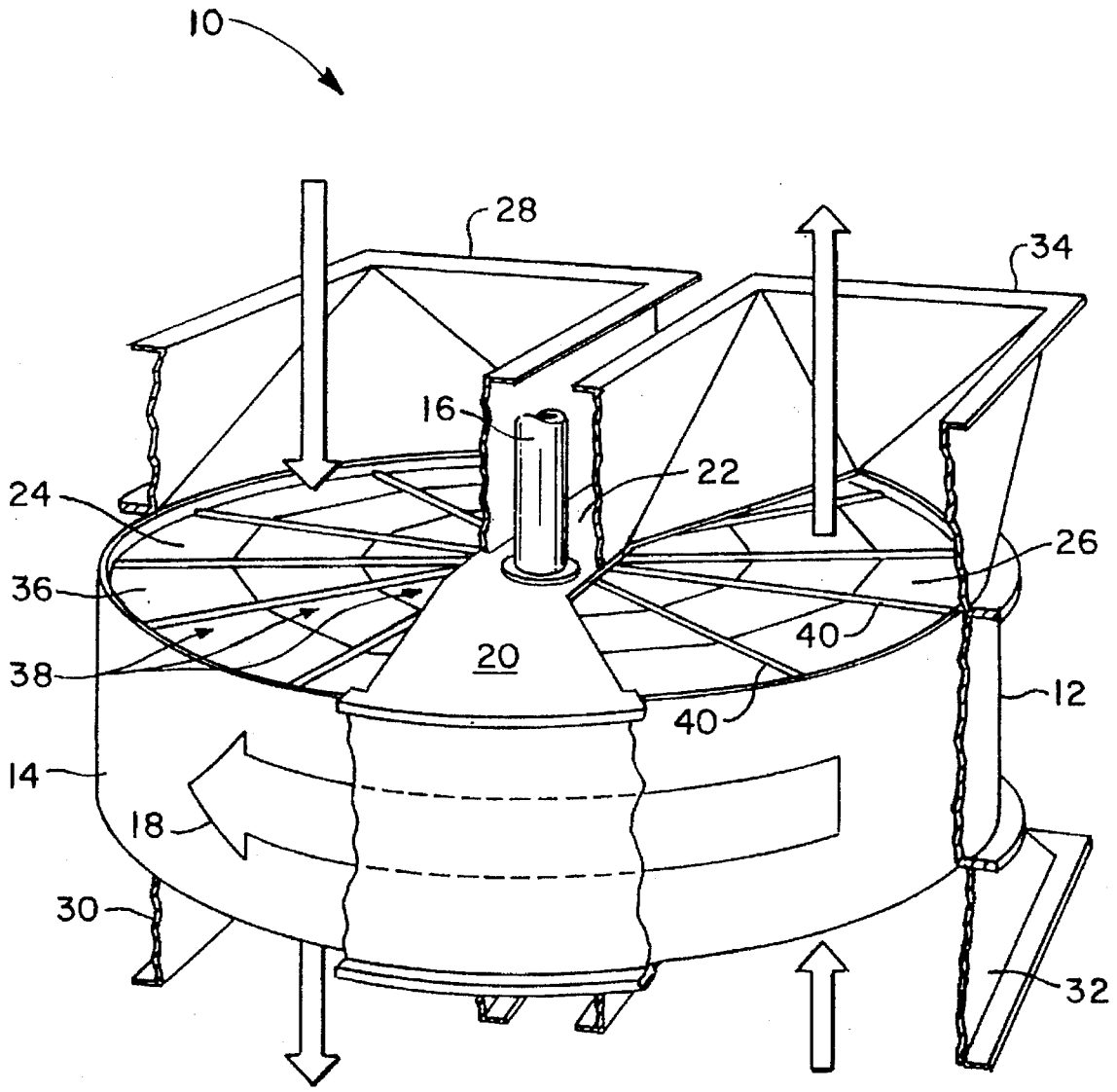
FIG. 1 PRIOR ART
FIG. 1 is a general perspective view of a conventional rotary regenerative air preheater.

FIG. 1 of the drawings is a partially cut-away perspective view of a typical bi-sector air preheater 10 showing a housing 12 in which the rotor 14 is mounted on a drive shaft or post 16 for rotation as indicated by the arrow 18. The housing is divided by means of the flow impervious sector plates 20, 22 into a flue gas side 24 and an air side 26. Corresponding sector plates are also located on the bottom of the unit. In a trisector air preheater (not shown), the rotor housing is divided into three sectors by the sector plates and include the flue gas sector, the primary air sector, and the secondary air sector. The hot flue gases enter the air preheater 10 through the gas inlet duct 28, flow through the sector where heat is transferred to the heat transfer surface in the rotor 14 and then exit through gas outlet duct 30. As this hot heat transfer surface then rotates through the air side 26, the heat is transferred to the air flowing through the rotor from the air inlet duct connector 32. The heated air stream forms a hot air stream and leaves the air preheater 10 through the duct connector section 34. Consequently, the cold air inlet and the cooled gas outlet 30 define a cold end of the heat exchanger and the hot gas inlet 28 and the heated air outlet define a hot end of the heat exchanger.

The rotor 14 is composed of a plurality of sectors 36 with each sector containing a number of basket modules 38 and with each sector being defined by the diaphragms 40. The basket modules 38 contain the heat exchange surface. The inboard end 42 of the diaphragms 40 are supported on upper and lower rotor post headers 44, 46. When the air preheater 10 is put into service, an axial temperature gradient develops from the hot end of the rotor 14 to the cold end of the rotor 14 as the preheater progresses from a cold non-operating condition to a hot operating condition. This axial temperature gradient causes the rotor 14 to distort. As a result, the upper portion 48 of the inboard end 42 of the diaphragms 40 moves axially upward.

Figure 2:
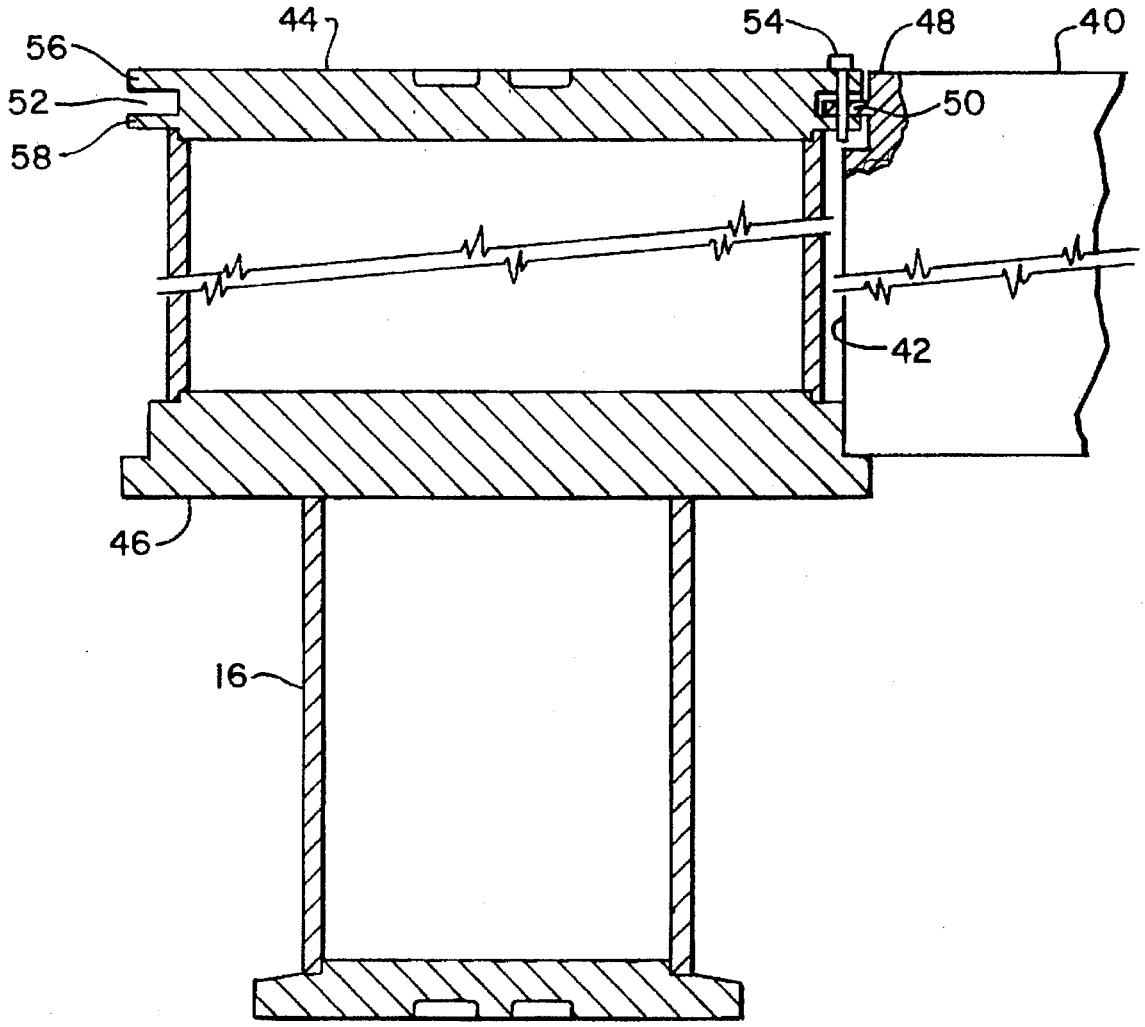
FIG. 2 PRIOR ART
FIG. 2 is a cross-section view, partly broken away, a prior art rotor post and rotor diaphragm of the air preheater of FIG. 1.

As shown in FIG. 2, a tongue 50 radially extends from the upper portion 48 of the inboard end 42 of the diaphragm 40 in conventional air preheaters. The tongue 50 is received in an annulus 52 in the upper rotor post header 44 and is pinned in place. As the air preheater 10 progresses from a cold condition to a hot condition on startup, the resulting deformation causes the tongue 50 to move axially upward on the pin 54. Such movement is opposed by friction between the tongue 50 and the pin 54, imposing a tensile stress on the diaphragm tongue 50, the pin 54 and the flanges 56, 58 on the upper rotor post header 44 that define the annulus 52. Consequently, the upper rotor post header 44 must include sufficient structure to provide an annulus 52 having a height that will allow movement of the diaphragm tongue 50 and flanges 56, 58 having a thickness sufficient to withstand the tensile stress imposed by the rotor distortion.

Figure 3:
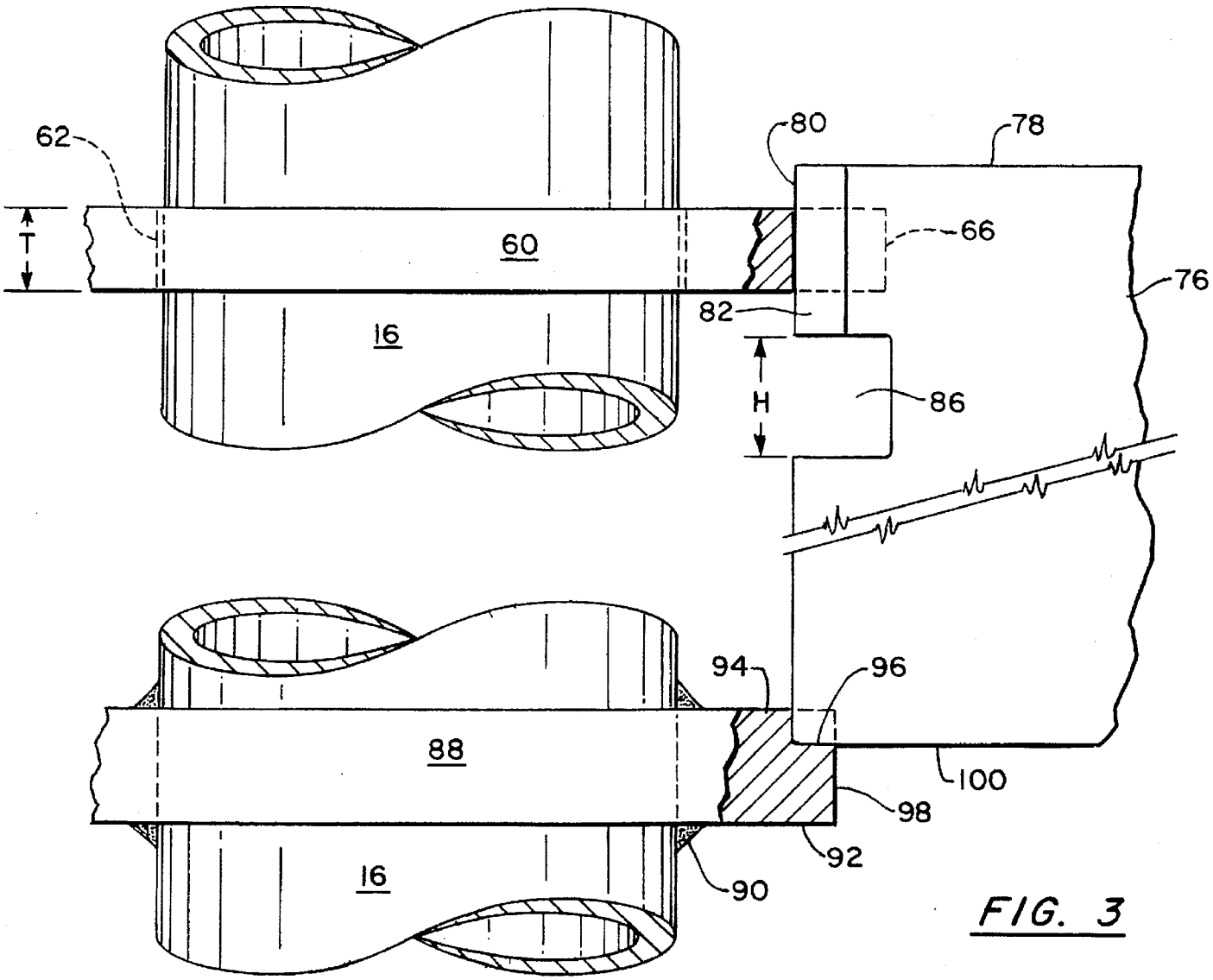
FIG. 3 is an enlarged cross-section view, partly broken away, of the rotor post, the upper and lower rotor post headers and a rotor diaphragm in accordance with the present invention.
Figure 4:
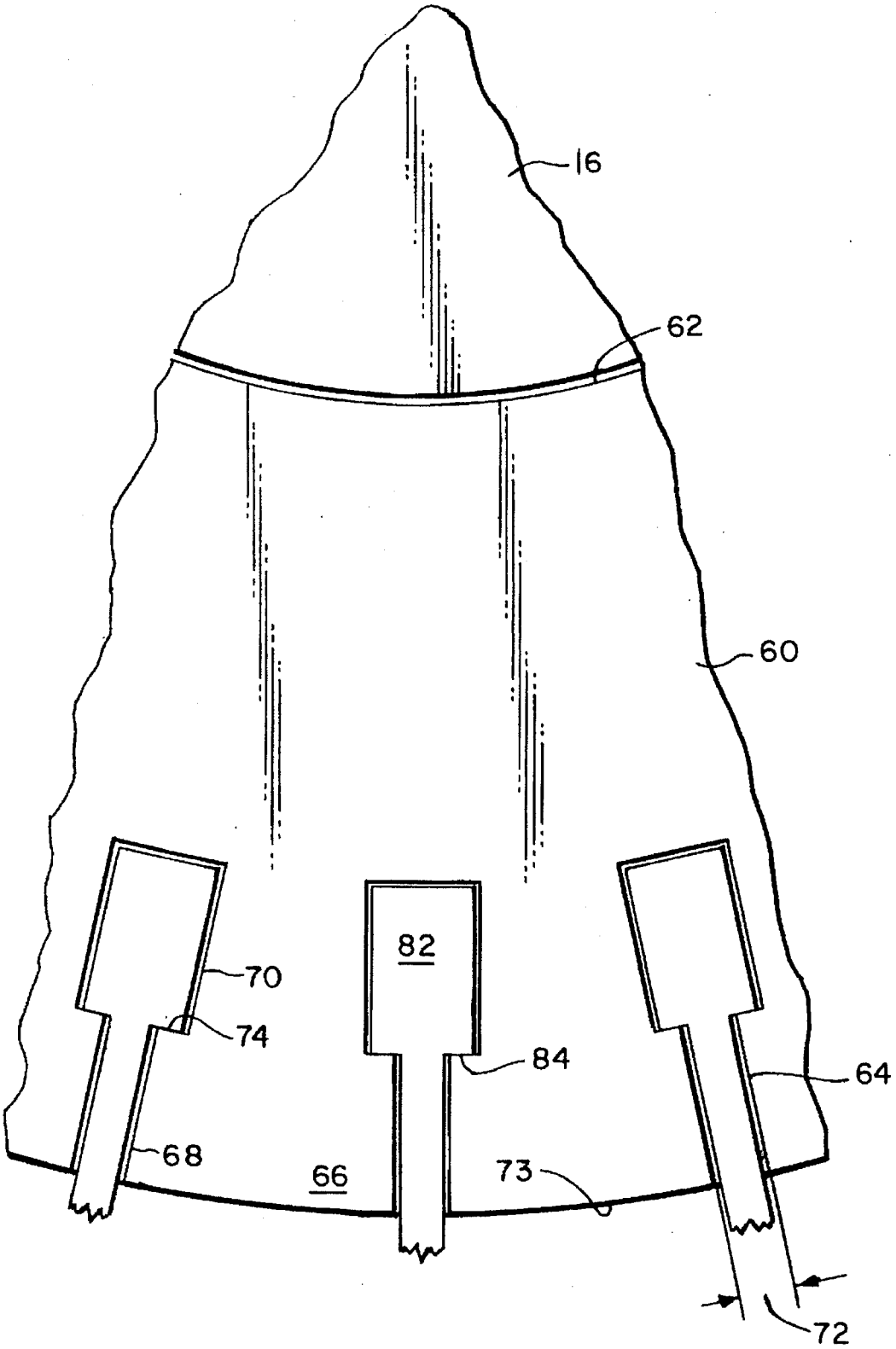
FIG. 4 is an enlarged top plan view of a portion of the upper rotor post header of FIG. 3 and portions of a plurality of rotor diaphragms.

In the present invention, the upper rotor post header 60 comprises a floating tensile ring having an interior opening 62 for receiving the rotor post 16. (FIGS. 3 and 4) A plurality of circumferentially spaced radially extending slots 64 are disposed in the outer peripheral portion 66 of the upper rotor post header 60. The outboard portion 68 of each slot 64 defines a gap 72 in the peripheral surface 73 of the header 60. The inboard portion 70 of each slot 64 defines a pair of shoulders 74, wherein the slot has a T-shape. The upper portion 78 of the inboard end 80 of each diaphragm 76 comprises a box-shaped lug 82 which is received in the inboard portion of one of the T-shaped slots 64. The shoulders 84 defined by the lug 82 engage the shoulders 74 defined by the inboard portion 70 of the slot 64 to prevent radial movement of the diaphragm 76. Each diaphragm 76 has a notch 86 disposed below the lug 82. The height H of the notch 86 is at least as great as the thickness T of the upper rotor post header 60. The diaphragm 76 is mounted to the upper rotor post header 60 by inserting the outer peripheral portion 66 of the upper rotor post header 60 into the notch 86, positioning the lug 82 of the diaphragm 76 over the inboard portion 70 of the slot 64, and lowering the diaphragm 76 such that the lug 82 is disposed in the inboard portion 70 of the slot 64.

During startup, the rotor deformation causes the upper rotor post header 60 to move axially upward on the rotor post 16. The radial force imposed on the upper rotor post header 60 by each diaphragm 76 is offset by the radial force imposed by one or more diaphragms 76 mounted on the opposite side of the upper rotor post header 60. Therefore, the rotor post 16 remains substantially centered within the interior opening 62. As an example, the thickness T of the upper rotor post header is six (6) inches for a given size and weight rotor. Such a header has a mass that is approximately fifty to sixty percent (50–60%) less than the mass of a comparable traditional upper header 44 for the same size and weight rotor, has sufficient mechanical strength to withstand the tensile stress imposed by the diaphragms 76, and may be smaller in diameter than the traditional upper header 44.

Figure 5:
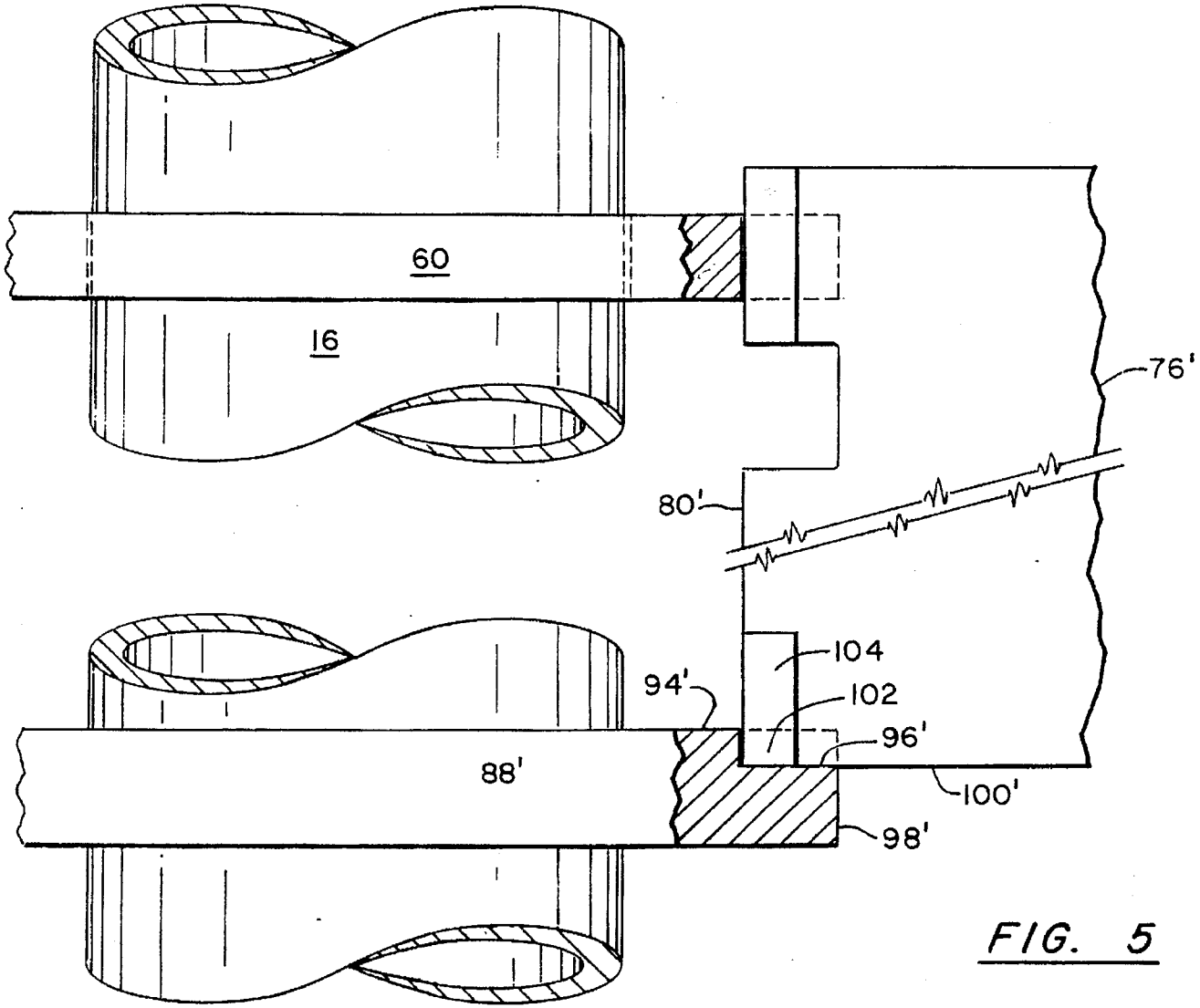
FIG. 5 is a cross-section view, partly broken away, of an alternate embodiment of the diaphragm and lower rotor postheader of FIG. 3.

Preferably, the lower rotor post header 88 is mounted to the rotor by a weld 90. The lower segment 92 of the outer peripheral portion 98 of the lower post header 88 radially extends beyond the upper segment 94 of the outer peripheral portion 90 to define a shelf 96. The lower portion 100 of the inboard end 80 of each diaphragm 76 rests on the shelf 96, whereby the diaphragms 76 are supported by the lower rotor post header 88. In one embodiment (FIG. 5), the upper segment 94' of the outer peripheral portion 98' of the lower post header 88' comprises a plurality of T-shaped slots 102 and the lower portion 100' of the inboard end 80' of each diaphragm 76' defines a box-shaped lug 104' which is received in a slot 102 to lock the diaphragm 76' to the rotor post 16. The bottom surface of each lug 104 rests on the shelf 96' of the lower post header 88'.

The relative thermal growth that occurred in the mounting connection of the traditional design between the diaphragms 40 and the upper post header 44 is eliminated by accommodating such growth between the bore of the floating tensile ring 60 and the post 16. The floating tensile ring 60 is centered on the post 16 by controlling the diameter of the post 16 and the opening or bore 62 of the ring 60 while allowing for thermal growth therebetween with no need for consideration of the actual total weight of the rotor 14 or the individual sectors 36.

The lower support header 88 of the present invention may be designed almost entirely based upon the dead weight of the rotor 14 since the excess axial load over and above the dead weight due to the relative thermal growth in the upper mounting connection has been reduced or eliminated. As a result, this excess axial loading on the lower header 88 is reduced by approximately eighty to ninety percent (80–90%). Consequently, for a given size and weight rotor 14, the required mass of the lower post header 88 of the present invention is reduced in excess of fifty percent (50%). In the present invention, the rotor post shell and connecting welds may be designed based on overturning moment reactions due to air and gas pressure drop through the heat transfer surfaces and radial pressure due to air to gas pressure differentials.

I claim:

1. Rotor apparatus for a rotary regenerative air preheater comprising:

a rotor post defining a substantially vertical rotation axis, the rotor post having a lower portion and an upper portion;

a first rotor header mounted to the lower portion of the rotor post and radially extending therefrom;

a second rotor header defining an axial opening for slidably receiving the upper portion of the rotor post and comprising an outboard peripheral portion defining a plurality of circumferentially spaced radially extending slots; and a plurality of radially extending diaphragms for defining sectors of the rotor apparatus, each of the diaphragms comprising an upper inboard portion and a lower inboard portion, the lower inboard portion of each diaphragm engaging the first rotor header whereby the first rotor header supports the diaphragms, the upper inboard portion of each diaphragm comprising a lug, each of the lugs being received in one of the slots and including means for engaging the slots whereby radial movement of the diaphragms is limited.

2. The rotor apparatus of claim 1 wherein each of the slots comprises an inboard portion and an outboard portion, the inboard portion of each slot defining a pair of shoulders for engagement with the lugs.

3. The rotor apparatus of claim 2 wherein each of the lugs defines a pair of shoulders, wherein the shoulders of the lug engage the shoulders of the slot.

4. The rotor apparatus of claim 1 wherein each of the diaphragms further comprises notch means disposed below the lug, said notch means being adapted for receiving the outboard peripheral portion of the second rotor header.

5. The rotor apparatus of claim 4 wherein the second rotor header has a thickness T and the notch means has a height H, wherein $H \geqq T$.

6. The rotor apparatus of claim I wherein the first rotor header is mounted to the rotor post by a weld.

7. The rotor apparatus of claim 1 wherein the first rotor header comprises an upper outboard segment and a lower outboard segment, and wherein the lower outboard segment radially extends beyond the upper outboard segment to define a shelf on which the diaphragms are supported.

8. The rotor apparatus of claim 7 wherein the upper outboard segment of the first rotor header defines a plurality of circumferentially spaced radially extending slots and the lower inboard portion of each diaphragm comprises lug means, each of the lug means being engageably received in one of the slots of the first rotor header.

9. The rotor apparatus of claim 8 wherein each of the slots comprises an inboard portion and an outboard portion, the inboard portion of each slot defining a pair of shoulders.

10. The rotor apparatus of claim 9 wherein each of the lug means defines a pair of shoulders, wherein the shoulders of the lug means engage the shoulders of each slot.

11. Rotor apparatus for a rotary regenerative air preheater having a vertical rotor post, the rotor post having lower and upper portions, the rotor apparatus comprising:

a first rotor header mounted to the lower portion of the rotor post comprising an upper outboard segment and a lower outboard segment, wherein the lower outboard segment radially extends beyond the upper outboard segment to define a shelf;

a second rotor header defining an axial opening for slidably receiving the upper portion of the rotor post and comprising an outboard peripheral portion defining a plurality of circumferentially spaced radially extending T-shaped slots; and a plurality of radially extending diaphragms for defining sectors of the rotor apparatus, each of the diaphragms comprising an upper inboard portion and a lower inboard portion, the lower inboard portion of each diaphragm engaging the shelf of the first rotor header, the upper inboard portion of each diaphragm comprising a lug, each of the lugs being engageably received in one of the slots.

12. The rotor apparatus of claim 11 wherein each of the lugs defines a pair of shoulders and each of the slots defines a pair of shoulders, wherein the shoulders of the lug engage the shoulders of the slot to prevent outward radial movement of the diaphragm.

13. The rotor apparatus of claim 11 wherein the second rotor header has a thickness T and each of the diaphragms further comprises notch means having a height H disposed below the lug, wherein $H \geqq T$.

14. The rotor apparatus of claim 11 wherein the upper outboard segment of the first rotor header defines a plurality of circumferentially spaced radially extending slots and the lower inboard portion of each diaphragm comprises lug means, each of the lug means being engageably received in one of the slots of the first rotor header.

15. The rotor apparatus of claim 14 wherein each of the lug means defines a pair of shoulders, wherein the shoulders of the lug means engage the shoulders of each slot.

* * * * *